US007102469B2

(12) United States Patent
Kim et al.

(10) Patent No.: US 7,102,469 B2
(45) Date of Patent: Sep. 5, 2006

(54) OPEN LOOP RESONATOR FILTER USING APERTURE

(75) Inventors: Young Wan Kim, Daejon (KR); Byung Su Kang, Daejon (KR); Nae-soo Kim, Daejon (KR); Deock Gil Oh, Daejon (KR); Chul Hen Seo, Seoul (KR); Serk Soon Im, Incheon (KR); Jae Hoon Kim, Seoul (KR)

(73) Assignee: Electronics and Telecommunications Research Institute, (KR)

( * ) Notice: Subject to any disclaimer, the term of this patent is extended or adjusted under 35 U.S.C. 154(b) by 36 days.

(21) Appl. No.: 10/452,863

(22) Filed: Jun. 2, 2003

(65) Prior Publication Data

US 2004/0104792 A1 Jun. 3, 2004

(30) Foreign Application Priority Data

Nov. 30, 2002 (KR) ..... 10-2002-0075685

(51) Int. Cl.
*H01P 1/20* (2006.01)

(52) U.S. Cl. ..... 333/204; 333/202

(58) Field of Classification Search ..... 333/204, 333/219, 99, 202; 505/210
See application file for complete search history.

(56) References Cited

U.S. PATENT DOCUMENTS 5,629,266 A * 5/1997 Lithgow et al. ..... 505/210
5,914,296 A * 6/1999 Shen ..... 505/210
6,130,591 A * 10/2000 Tsuzuki ..... 333/204
6,313,722 B1 * 11/2001 Tsuzuki et al. ..... 333/219.1
6,480,078 B1 * 11/2002 Kim et al. ..... 333/219.1
6,791,432 B1 * 9/2004 Smith et al. ..... 333/99 S
2003/0234706 A1 * 12/2003 Silk et al. ..... 333/202
2004/0027211 A1 * 2/2004 Yi ..... 333/99 S

FOREIGN PATENT DOCUMENTS

KR 1020000015176 3/2000
KR 1020000039409 7/2000

OTHER PUBLICATIONS

2002 IEEE MTT-S International Microwave Symposium Digest, vol. 1, "Improvement of Microstrip Open Loop Resonator Filter Using Aperture", 5 pages.
"Aperature-Coupled Microstrip Open-Loop Resonators and Their Applications to the Design of Novel Microstrip Bandpas Filters", J. Hong, et al., Sep. 1999 IEEE, vol. 47, No. 9, 8 pages.

* cited by examiner

*Primary Examiner*—Rexford Barnie
*Assistant Examiner*—Joseph Lauture
(74) *Attorney, Agent, or Firm*—Blakely Sokoloff Taylor & Zafman

(57) ABSTRACT

An open loop resonator filter employed aperture on the ground plane is disclosed. The open loop resonator filter using apertures on the ground plane formed on the dielectric substrate, the open loop resonator filter including: one or more open loop resonators formed on a upper side of the dielectric substrate and implemented by microstrip lines; and one or more apertures formed on a predetermined area of the ground plane. The present invention can control the coupling coefficient of the open loop resonator without degrading the group delay characteristics by forming the aperture on the ground plane. Therefore, by forming the aperture on the ground plane, it is possible to design a filter having a wide bandwidth characteristic.

2 Claims, 5 Drawing Sheets

OPEN LOOP RESONATOR FILTER USING APERTURE

FIELD OF THE INVENTION

The present invention relates to an open loop resonator filter using an aperture on the ground plane; and, more particularly, to an open loop resonator filter with an aperture providing the wide bandwidth and high selectivity characteristics for high-speed data transmission system.

DESCRIPTION OF THE RELATED ARTS

In modern communication system, a filter for a radio frequency (RF) or an intermediate frequency (IF) has been required to be small, to be easily fabricated, to have flat group delay and especially, wide bandwidth because of high-speed data rate.

Although a surface acoustic wave (SAW) filter has been widely used because of its recognizable selectivity. However, the SAW filter is not applicable to broadband system for bad group delay ripple and narrow bandwidth. Thus, it is too difficult to implement the SAW filter into the high-speed communication system that requires wide bandwidth.

In a meantime, a filter using a microstrip is easy to be manufactured and easy to be miniaturized. Therefore, there are many studies progressed for developing the filter using microstrip in various forms. However, in case the conventional half wavelength type resonator is used for the filter, there is a problem for miniaturization of the filter since multiple layers of the resonator are necessary for high selectivity, small insertion loss and flat group delay characteristics.

For overcoming abovementioned problem, a half wavelength open loop resonator has been used for a small filter fabrication in fields of narrowband communication circuit, especially a mobile communication. However, there is no study been progressed for wideband communication application like a high-speed satellite communication.

Generally, the wide bandwidth of the open loop resonator filter can be obtained by tight coupling between loops which mean higher coupling coefficient. It is possible by reducing a coupling gap between loops and thickness of microstrip line.

However, the pass-band ripple also is large because the difference between two resonant frequencies due to tight coupling is large. Also, there is a limitation on reducing coupling space between loops for tight coupling.

In case the coupling space between loops is extremely narrow, the sensitivity of the filter can become serious problem and it is difficult to fabricate the filter.

For broadening of the filter bandwidth, the aperture is employed on the ground of the coupled line in open loop resonator filter.

FIGS. 1A and 1B are a diagram for explaining magnetic coupling of an open loop resonator employing aperture. A circuit of FIG. 1B is an equivalent circuit of FIG. 1A.

In conventional open loop resonator filter structure, the wider bandwidth is achieved by decreasing the coupling gap d. As referring FIGS. 1A and 1B, the difference between two resonance frequencies become wider by increasing the aperture width w. Therefore, the effect of the increased aperture width w is same as that of the decreased coupling space d of the conventional structure with no aperture.

A coupling coefficient and resonance frequency of the open loop resonator with magnetic coupling of FIG. 1A can be expressed as following equations 1 and 2.

$$f_m = \frac{1}{2\pi fC(L - L_m)},\ f_e = \frac{1}{2\pi fC(L + L_m)} \qquad \text{Eq. 1}$$

$$K_E = \frac{L_m}{L} \qquad \text{Eq. 2}$$

In Eqs. 1 and 2, C represents a self-capacitance and L is a self-inductance. $L_m$ is a mutual inductance.

Similar equations of Eqs. 1 and 2 are implemented for electric coupling and electro-magnetic coupling. Among the coupling methods, a coupling method having the biggest difference between two resonance frequencies is the magnetic coupling. That is, the bandwidth can be mainly controlled by coupling coefficient of the magnetic coupling.

On the other hand, if the coupling gap between two open loop resonators is narrower, which is a case of FIG. 1A without an aperture, then the mutual inductance $L_m$ is increased and the difference between two resonance frequencies $f_e$ and $f_m$ is also increased.

However, in case of reducing the coupling gap between lines and thickness of line in the above mentioned conventional open loop resonator, it causes to increase a ripple of the pass-band. Also, if the gap becomes extremely narrowed, manufacturing process of a circuit will be very complicated because of a responsiveness of manufacturing.

SUMMARY OF THE INVENTION

It is, therefore, an object of the present invention to provide a small size open loop resonator filter structure with wide bandwidth, flat group delay and superior selectivity characteristics by forming an aperture on a predetermined portion of a ground plane.

In accordance with an aspect of the present invention, there is provided an open loop resonator filter employed aperture on the ground plane, the open loop resonator filter including: one or more open loop resonators formed on a upper side of the dielectric substrate and implemented by microstrip lines; and one or more apertures on a predetermined area of the ground plane.

BRIEF DESCRIPTION OF THE DRAWING(S)

The above and other objects and features of the present invention will become apparent from the following description of the preferred embodiments given in conjunction with the accompanying drawings, in which.

DETAILED DESCRIPTION OF THE INVENTION

Other objects and aspects of the invention will become apparent from the following description of the embodiments with reference to the accompanying drawings, which is set forth hereinafter.

Figure 1A:
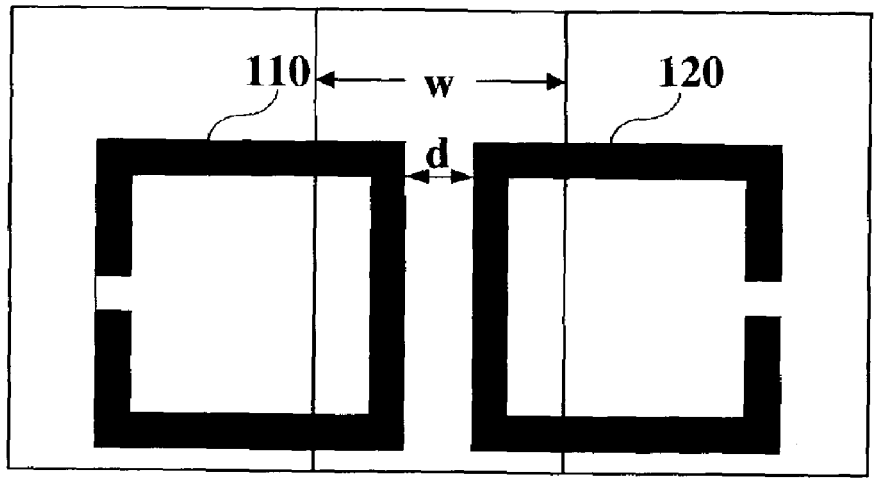
FIGS. 1A and 1B are a diagram for explaining magnetic coupling of an open loop resonator using an aperture on the ground plane.
Figure 1B:
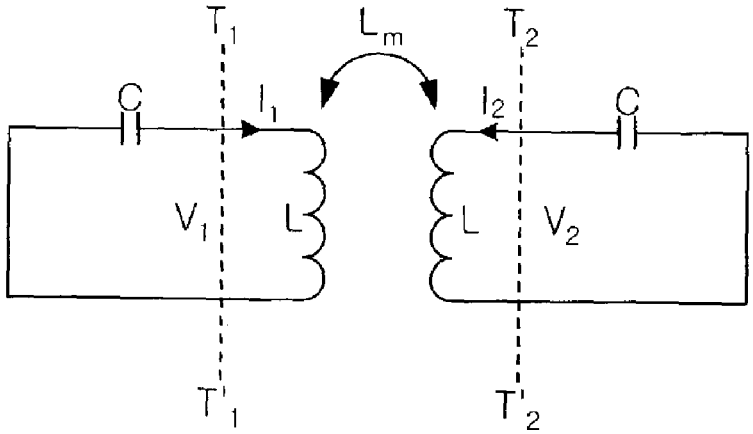

FIGS. 1A and 1B are a diagram for explaining magnetic coupling of an open loop resonator using an aperture. A circuit of FIG. 1B is an equivalent circuit of FIG. 1A.

Figure 2:
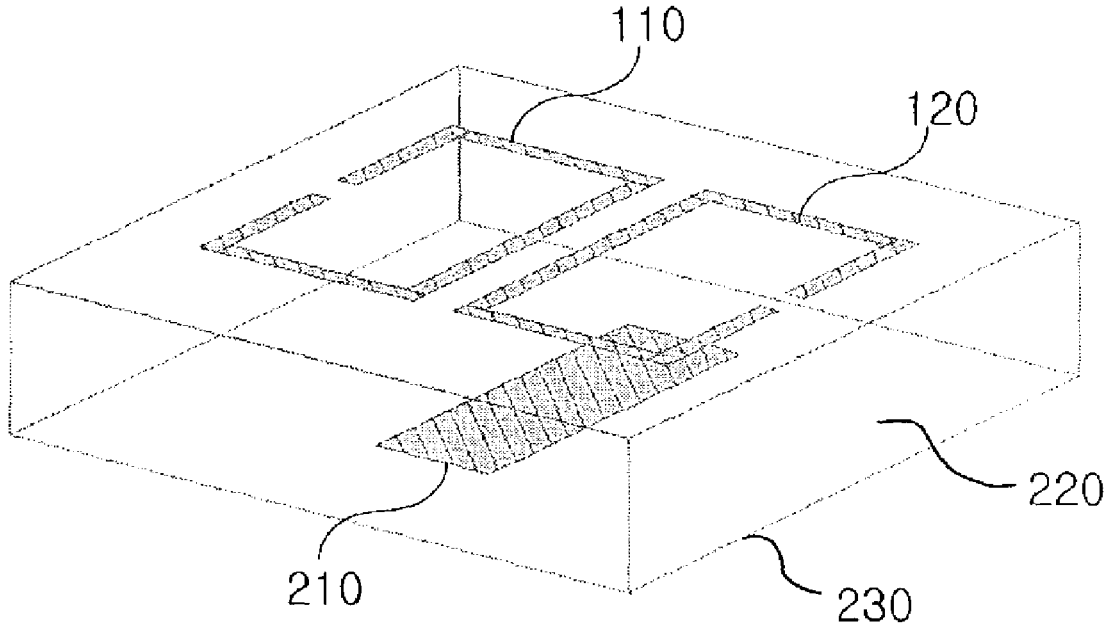
FIG. 2 is a perspective view of an open loop resonator filter using an aperture in accordance with a preferred embodiment of the present invention.

FIG. 2 is a perspective view of an open loop resonator filter using an aperture in accordance with a preferred embodiment of the present invention.

As referring to FIG. 2, the open loop resonator filter includes open loop resonators 110 and 120, an aperture 210, a dielectric substrate 220 and a ground plane 230.

The open loop resonators 110 and 120 are formed by microstrip lines.

The aperture 210 is formed on a predetermined position of the ground plane 230 and the predetermined position is a downwardly projected position from a position of an upper side where two resonators are faced and a gap coupling is occurred.

According to the present invention, the bandwidth of the filter can be controlled by width of the aperture 210 without changing a coupling gap d of the open loop resonators 110 and 120.

Figure 3A:
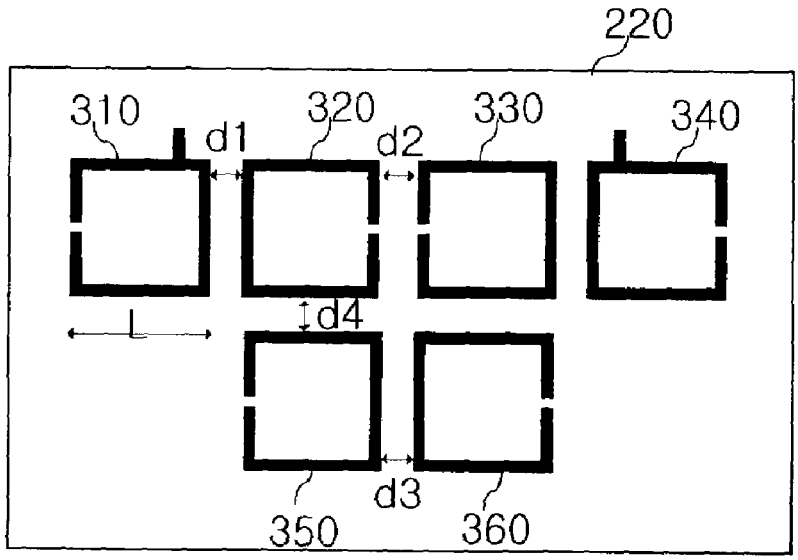
FIG. 3A is a upper side view of an open loop resonator filter using aperture in accordance with another preferred embodiment of the present invention.

FIG. 3A is a perspective view of an open loop resonator filter using an aperture in accordance with another preferred embodiment of the present invention. The open loop resonator filter of FIG. 3A has 6 poles and FIG. 3B is a rear view of the FIG. 3A.

Figure 3B:
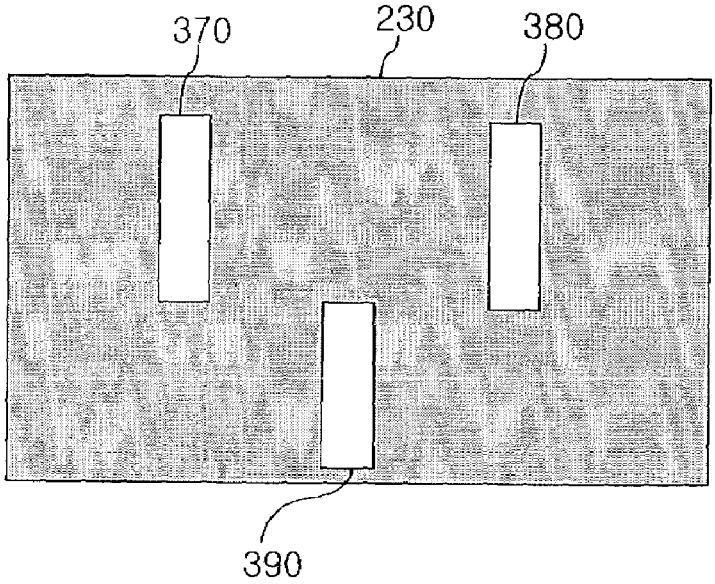
FIG. 3B is a rear view forming aperture of the FIG. 3A.

Referring to FIGS. 3A and 3B, the open loop resonator includes a plurality of open loop resonators 310 to 360, a plurality of aperture 370, 380 and 390, a dielectric substrate 220 and a ground plane 230.

The aperture 370, 380 and 390 are used for coupling each of open loop resonators 310 and 320, 330 and 340, and 350 and 360.

Figure 4:
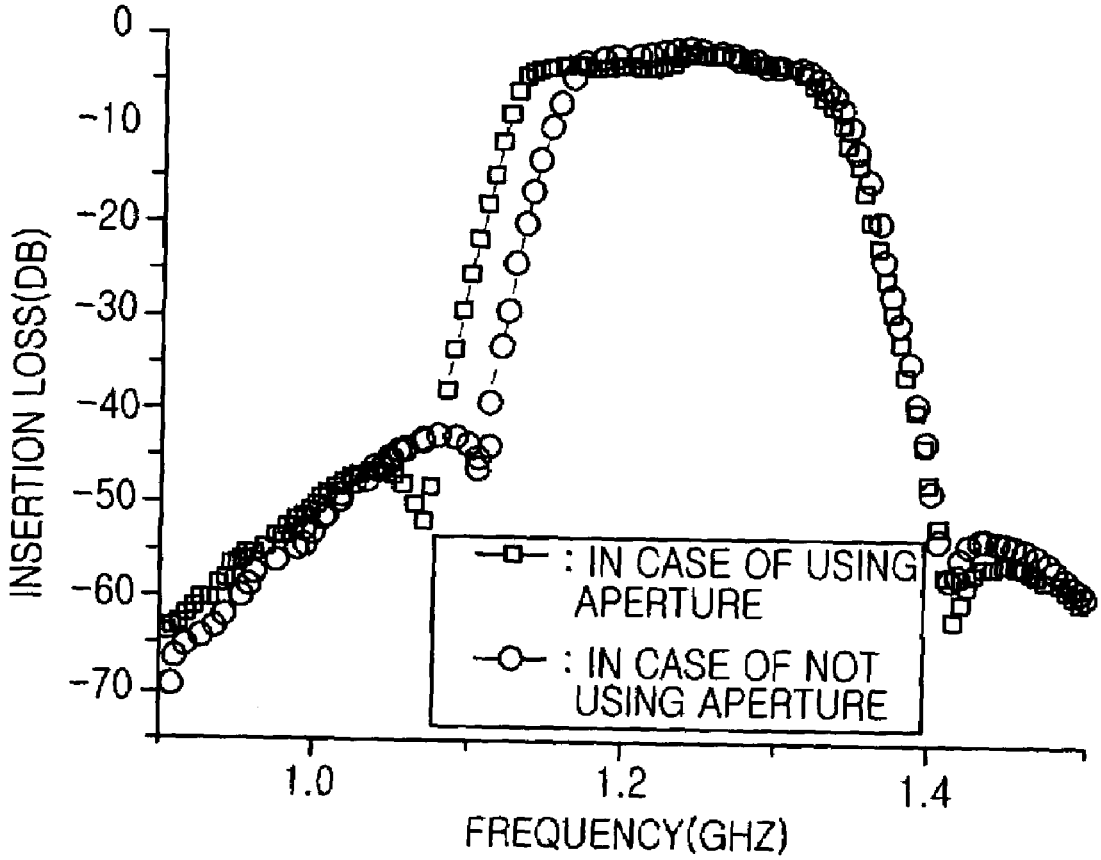
FIG. 4 is graph for explaining the amplitude transfer characteristics of the open loop resonator filter of FIG. 3.

FIG. 4 is a graph for explaining the amplitude transfer characteristics of the open loop resonator filter of FIG. 3. The open loop resonator filter of the present invention is compared with a conventional open loop resonator filter without the aperture.

For accurate comparison, two filters have same condition such as a length of open loops L and gap d between loops. Only difference of two filters is implementation of the aperture.

As shown in FIG. 4, the bandwidth of the filter with aperture is increased by 25% comparing to the filter with no aperture.

Figure 5:
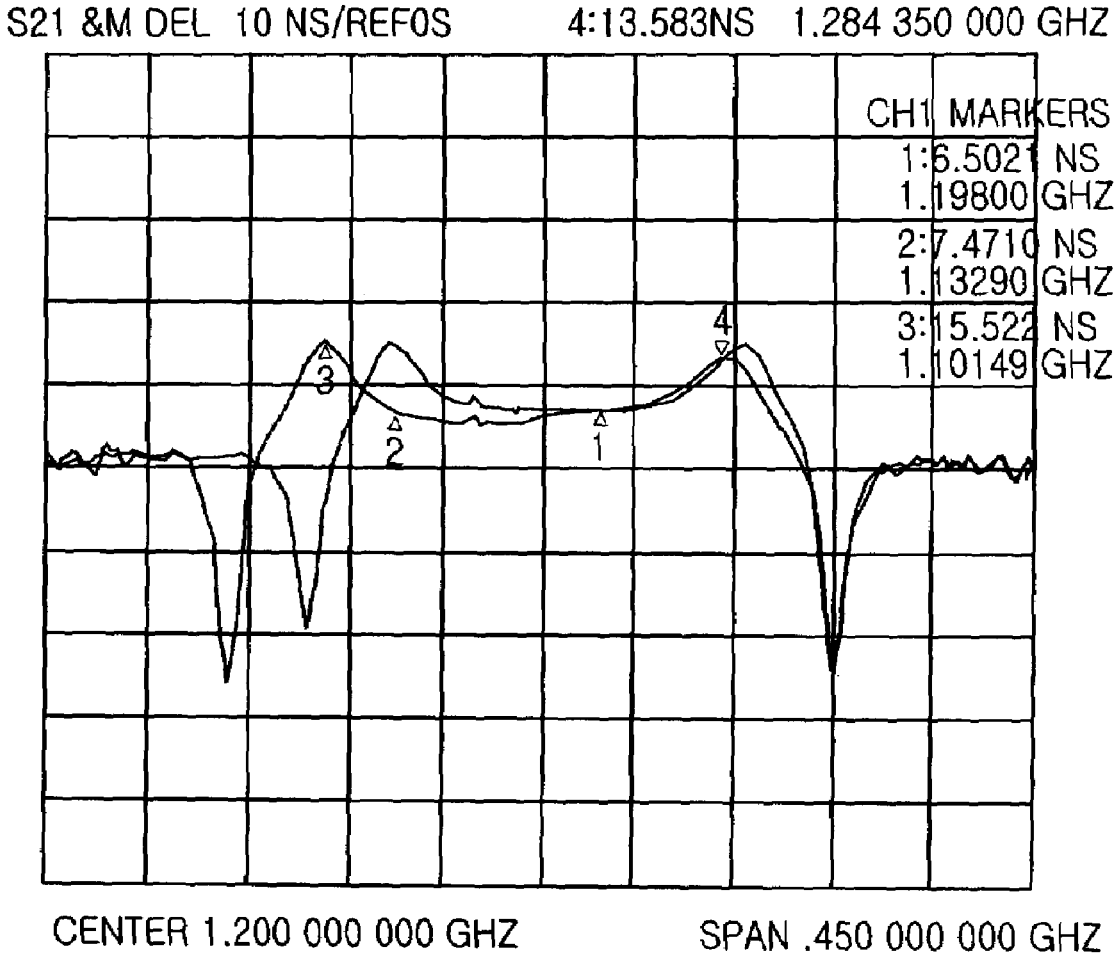
FIG. 5 is a graph for explaining the group delay characteristics of the open loop resonator filter in FIG. 3.

FIG. 5 is a graph for explaining a group delay characteristics of the open loop resonator filter in FIG. 3. The open loop resonator filter of the present invention is compared with an open loop resonator filter without the aperture.

Referring to FIG. 5, the open loop resonator filter of the present invention does not degrade the group delay characteristics comparing to the filter without the aperture.

As mentioned above, the present invention can control the coupling coefficient of the open loop resonator without degrading the group delay characteristics by forming the aperture on the ground plane. Therefore, by forming the aperture on the ground plane, it is possible to design a filter having a wide bandwidth characteristic.

While the present invention has been described with respect to certain preferred embodiments, it will be apparent to those skilled in the art that various changes and modifications may be made without departing from the scope of the invention as defined in the following claims.

What is claimed is:

1. An open loop resonator filter using apertures on an underlying ground plane of a dielectric substrate, the open loop resonator filter comprising:

a plurality of open loop resonators formed in a single layer on an upper side of the dielectric substrate and implemented by microstrip lines; and at least one aperture formed on a predetermined area of the underlying ground plane to couple the resonators on the upper side of the dielectric substrate, wherein each of the resonators has a shape of an open loop and is disjoint from the other resonators, wherein the at least one aperture is formed on predetermined portions of the underlying ground plane, wherein the predetermined portion is a downwardly projected position from a position of the upper side where a gap coupling of two of the resonators occurred.

2. An open loop resonator filter using apertures on an underlying ground plane of a dielectric substrate, the open loop resonator filter comprising:

a plurality of open loop resonators formed on an upper side of the dielectric substrate and implemented by microstrip lines; and at least one aperture formed on a predetermined area of the underlying ground plane to couple the resonators on the upper side of the dielectric substrate, wherein the aperture is formed on predetermined portions of the underlying ground plane, wherein the predetermined portion is a downwardly projected position from a position of the upper side where a gap coupling of two of the resonators occurred.

* * * * *